US008905238B2

(12) United States Patent
Park

(10) Patent No.: US 8,905,238 B2
(45) Date of Patent: Dec. 9, 2014

(54) POD PACKAGING SYSTEM

(76) Inventor: Fa Young Park, Leonia, NJ (US)

( * ) Notice: Subject to any disclaimer, the term of this patent is extended or adjusted under 35 U.S.C. 154(b) by 0 days.

(21) Appl. No.: 13/344,689

(22) Filed: Jan. 6, 2012

(65) Prior Publication Data

US 2012/0103865 A1 May 3, 2012

Related U.S. Application Data

(60) Provisional application No. 61/493,830, filed on Jun. 6, 2011.

(51) Int. Cl.

| | |
|---|---|
| ***B65D 25/54*** | (2006.01) |
| ***B65D 5/50*** | (2006.01) |
| ***B65D 5/42*** | (2006.01) |
| ***B65D 75/36*** | (2006.01) |
| ***A45D 29/00*** | (2006.01) |

(52) U.S. Cl.

CPC ..... *B65D 5/5028* (2013.01); *B65D 5/4204* (2013.01); *B65D 75/366* (2013.01); *A45D 29/001* (2013.01)

USPC ..... 206/581; 206/776

(58) Field of Classification Search

USPC ..... 206/581, 461, 471, 775, 776, 777, 778, 206/730, 779; 132/73, 200; D28/56

See application file for complete search history.

(56) References Cited

U.S. PATENT DOCUMENTS

| | | | | |
|---|---|---|---|---|
| 3,656,612 | A * | 4/1972 | Sellors | 206/782 |
| 3,675,763 | A * | 7/1972 | Sandel | 206/387.11 |
| 3,682,297 | A * | 8/1972 | Austin et al. | 206/387.11 |
| 4,106,614 | A * | 8/1978 | Aylott | 206/581 |
| 4,140,139 | A * | 2/1979 | Aylott | 132/73 |
| 4,146,128 | A * | 3/1979 | Hogg et al. | 206/776 |
| 4,361,226 | A * | 11/1982 | Travis | 206/777 |
| 4,415,079 | A * | 11/1983 | Ackeret | 206/455 |
| 4,511,608 | A * | 4/1985 | Ferraro | 428/15 |
| 4,925,023 | A * | 5/1990 | Goldblatt et al. | 206/308.2 |
| 4,954,190 | A * | 9/1990 | Taeckens | 156/61 |
| 5,184,724 | A * | 2/1993 | Mayled | 206/466 |
| 5,396,985 | A * | 3/1995 | Seki | 206/459.5 |
| 5,409,105 | A * | 4/1995 | Appelbaum et al. | 206/6.1 |
| 5,791,482 | A * | 8/1998 | Murphy et al. | 206/581 |
| 5,816,408 | A * | 10/1998 | Indelicato | 206/581 |
| 5,944,183 | A * | 8/1999 | Rowland et al. | 206/313 |
| 6,042,679 | A * | 3/2000 | Holt et al. | 156/249 |
| 6,626,183 | B1 * | 9/2003 | Pietrocola et al. | 132/73 |
| 6,758,340 | B1 * | 7/2004 | Feibelman | 206/775 |
| 7,389,876 | B2 * | 6/2008 | Hong et al. | 206/581 |
| 7,628,278 | B2 * | 12/2009 | Coppola | 206/733 |
| 8,061,364 | B2 * | 11/2011 | Park | 132/73 |

(Continued)

OTHER PUBLICATIONS

Laquerized—A blog about nail polish "Review: Essence Studio Nails—Nail Fashioon Stickers" [Online] Sep. 25, 2010, Retrieved from Internet: URL:http://www.lacquerized.com/2010/09/review-essence-studio-nails-nail.html [retrieved on Jul. 29, 2012].*

U.S. Appl. No. 13/804,139 on "Dry Nail Applique Packaging System" filed Mar. 14, 2013 (21 pages).

*Primary Examiner* — Steven A. Reynolds

(74) *Attorney, Agent, or Firm* — Carrie Stroup

(57) ABSTRACT

A pod package for nail appliqués formed of enamel in which a pod is used to hold a number of nail appliqués stacked one on another. The pod is made of a well that is sealed in an airtight fashion. The pod is held in a rectangular container that is sized and shaped to fit on standard nail polish displays.

13 Claims, 3 Drawing Sheets

(56) References Cited

U.S. PATENT DOCUMENTS

2002/0197435 A1* 12/2002 Ra A ..... 428/42.1
2005/0061342 A1* 3/2005 Chapman ..... 132/73
2005/0150508 A1* 7/2005 Downs et al. ..... 132/73
2005/0199253 A1* 9/2005 Fiore et al. ..... 132/73
2005/0255061 A1* 11/2005 Park ..... 424/61
2008/0283073 A1* 11/2008 Park ..... 132/73
2010/0275942 A1* 11/2010 Barile ..... 132/200

* cited by examiner

POD PACKAGING SYSTEM

RELATED APPLICATIONS

This application claims the benefit of U.S. Provisional Application Ser. No. 61/493,830 filed on Jun. 6, 2011, the contents of which are fully incorporated herein by reference.

FIELD OF THE INVENTION

The current invention relates generally to packaging systems, more specifically to a novel apparatus and method of packaging nail appliqués.

BACKGROUND OF THE INVENTION

This invention relates to a new and novel packaging for nail appliqués comprising real nail enamel.

Applicant is the inventor of dry nail appliqués made of real nail enamel which are quick drying are applied to fingernails and the like for effective quick manicure effects. Prior packaging for such appliqués has a row of appliqués attached side to side and displayed in a clear window.

The nail appliqués require that they be sealed when initially manufactured so as to prevent drying of the enamel prior to application and prior to being removed from the package.

SUMMARY OF THE INVENTION

The invention described herein is a new and improved nail appliqué packaging system and method of packaging and displaying appliqués. In the inventive packaging, nail appliqués are arranged in a stack and placed in a transparent pod. The pod is positioned against a window of an outer package—allowing users to view the nail appliqués located in the pod.

An object of this invention is to provide an improved package for nail appliqués containing real nail enamel.

Another object of this invention is to provide such packaging in which the package is sealed and which consists of minimal surface area, thereby preventing drying of the nail appliqués.

Still another object of this invention is to provide such a package in which different sized nail appliqués are located one behind the other for easy viewing of the overall pattern.

Yet another object of this invention is to provide a pod structure, easily opened to remove individual appliqués and closed air tight, holding the remaining nail appliqués one behind the other.

Still another object of this invention is to provide such packaging, which may be conveniently carried in conventional retail displays far easy viewing and purchase by the consumer.

Still another object of this invention is to provide such a package or pod in which double ended nail appliqués can be provided so that the consumer can open and apply the appliqués to one hand at a time and can apply the packaged appliqués to both hands with a single pod.

Other objects, advantages and features of this invention will become more apparent from the following description.

DETAILED DESCRIPTION OF THE INVENTION

Embodiments of the present invention will now be described with reference to the above-identified Drawings. However, the Drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

Figure 1:
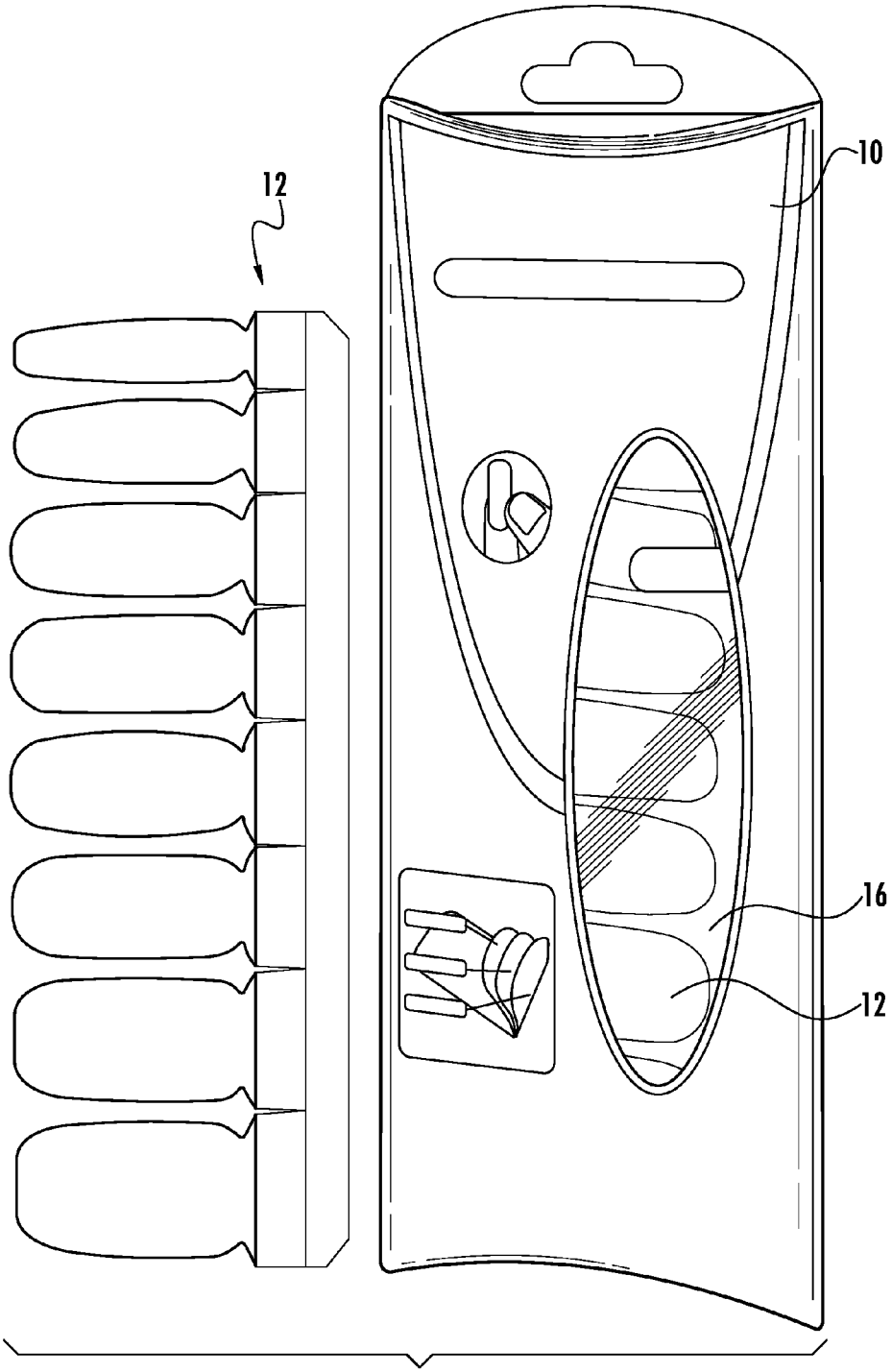
FIG. 1 (PRIOR ART)
FIG. 1 is a top view of a prior art nail appliqué package and a strip of nail appliqués.

FIG. 1 shows prior art packaging 10, in which a sheet of attached nail appliqués 12 is placed into a flat, elongated package 10. As shown, the appliqués 12 aligned in a row are visible through a clear window 16. The large sheet like package shown in FIG. 1 is too large for conventional nail polish counter displays and other hanging display hooks.

Figure 2:
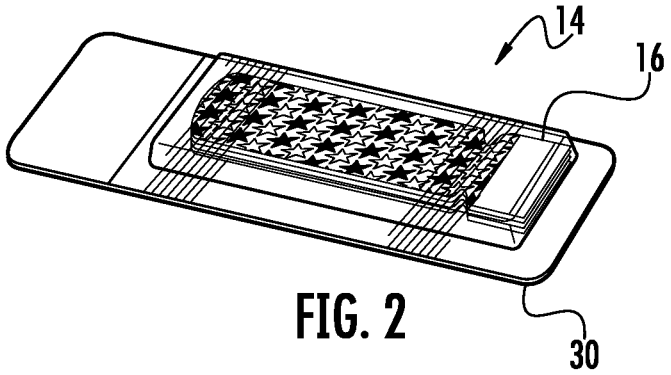
FIG. 2 is a top, perspective view of a nail pod containing nail appliqués according to an embodiment of the invention.

FIG. 2 shows a pod 14 according to an embodiment of the invention. As shown, pod 14 has a well portion 16 for holding a stack of individual nail appliqués 18 and a backing portion 30 for sealing the well 16.

Figure 3:
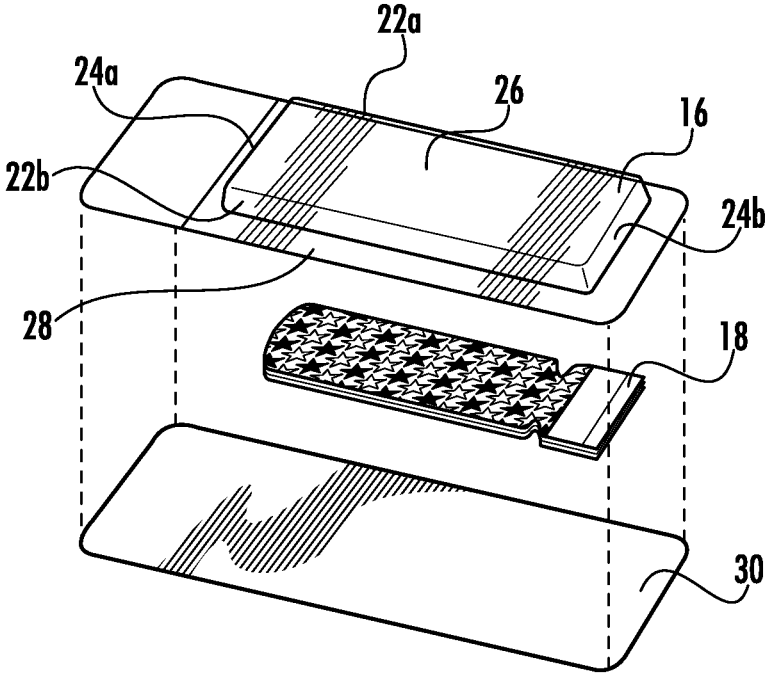
FIG. 3 is an exploded view of the pod and appliqués of FIG. 2.

FIG. 3 shows an exploded view of the pod and appliqués of FIG. 2. As shown, pod 14 comprises a well 16 in which a stack of appliqués 18 is seated. The well 16 is sufficiently recessed so as to accommodate a suitable number of appliqués 18 in the stack.

The well is generally rectangular in shape and it comprises two parallel sidewalls 22*a*, 22*b*, front and rear walls 24*a*, 24*b* and a floor 26 (note that floor 26 has an inner face which receives a stack of appliqués and an outer face which is the outside surface of the pod). A lip 28 extends outwardly from the tops of the walls of the well 22, at a roughly 90° angle. Such lips form a peripheral area around the well and function as a sealing area to receive a backing sheet 30 or pod cover.

In use, a stack of appliqués is seated in the well 16 and the backing sheet 30 is then adhered to the lips 28 to form an airtight seal.

The well 16 is preferably formed of a clear or translucent plastic material to allow the outermost appliqué to be viewed from the outside while the pod is still sealed closed. In one embodiment of the invention, backing sheet could form a living hinge with lip 28—allowing opening and closing of the same.

Some appliqués may be double-ended such that a single appliqué could be used for two different fingers. A pod holding double-ended appliqués can carry enough appliqués to coat fingernails of both hands. The size of the individual appliqués will be slightly varied to adapt to different size fingernails on each user. The well of the pod is sized to accommodate the largest of the appliqués and the user can choose one or another of the appliqués within the stack allowing the remainder to stay in place.

Appliqués for each hand may be separately packaged in its own sealed container one stacked one behind the other. Providing individual appliqués or double-ended appliqués one behind the other in a stacked relation allows the user to individually select the size appliquéwhich would most conveniently fit the fingernail without having to cut apart a strip of appliqués like the nail appliqué strip 12 as shown in FIG. 1. The pod configuration additionally minimizes and significantly reduces the surface area required to package nail appliqués—allowing for a tighter seal. Moreover, less plastic is required than the prior art appliqué packages.

In a preferred embodiment of the invention, the pod 14 is packaged in a container that is rectangular or cylindrical in shape. The container is sized and shaped to be roughly the same size as containers that are used to package bottles of conventional nail polish. In this manner, the container fits on the display cases that are commonly used to display nail polish in retail establishments.

Figure 4:
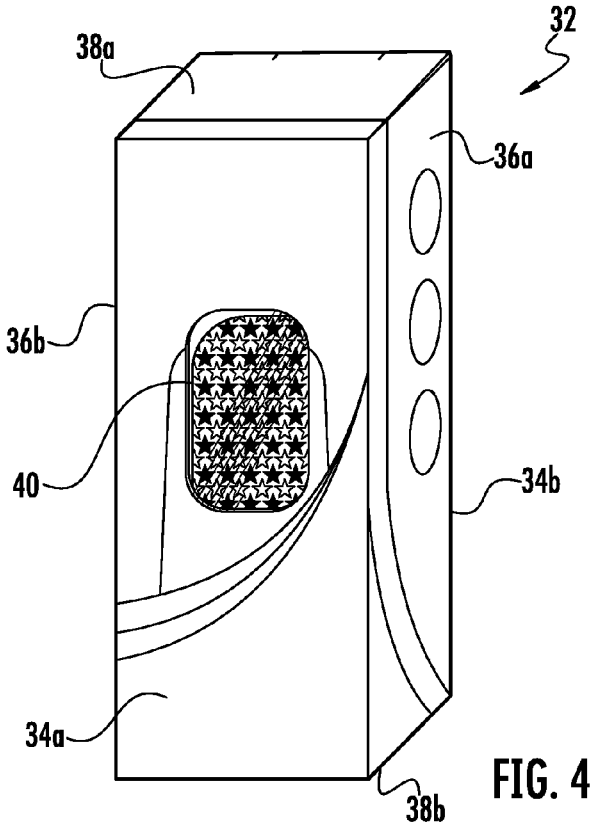
FIG. 4 is a front, perspective view of a container for holding pods of appliqués according to an embodiment of the invention.

FIG. 4 shows a rectangular container 32 for holding pods 14 according to an embodiment of the invention. As shown, container 32 has a front wall 34*a*, rear wall 34*b*, sidewalls 36*a*, 36*b*, top wall 38*a* and bottom wall 38*b*. A cutout 40 is made in front wall 34*a*—thus creating a window into container 32. In a preferred embodiment, the cutout 40 is covered with a plastic or such similar transparent or translucent material.

The dimensions of bottom wall 38*b* are roughly the same dimensions of similar containers that hold nail polish bottles. As such, container 32 could be seated or positioned in display cases that designed to carry nail polish bottles. In a preferred embodiment, the dimensions of bottom wall 38*b* are roughly 1 5/16 inches by 1 5/16 inches; however, any such similar dimensions are possible. The height of container also is similar or roughly the same as the height of containers in which conventional nail polish bottles are sold.

In a preferred embodiment of the invention, a pod 14 is positioned in the container 32, such that the outer face of floor 26 is aligned with cutout 40. Because floor 26 of pod 14 is made of transparent material as is any cover provided on cutout 40—the appliqués 18 stored inside of the pod 14 are visible from the outside of container 32. This allows a user to browse at a container 32 and easily see the appliqués 18 carried therein.

Figure 5:
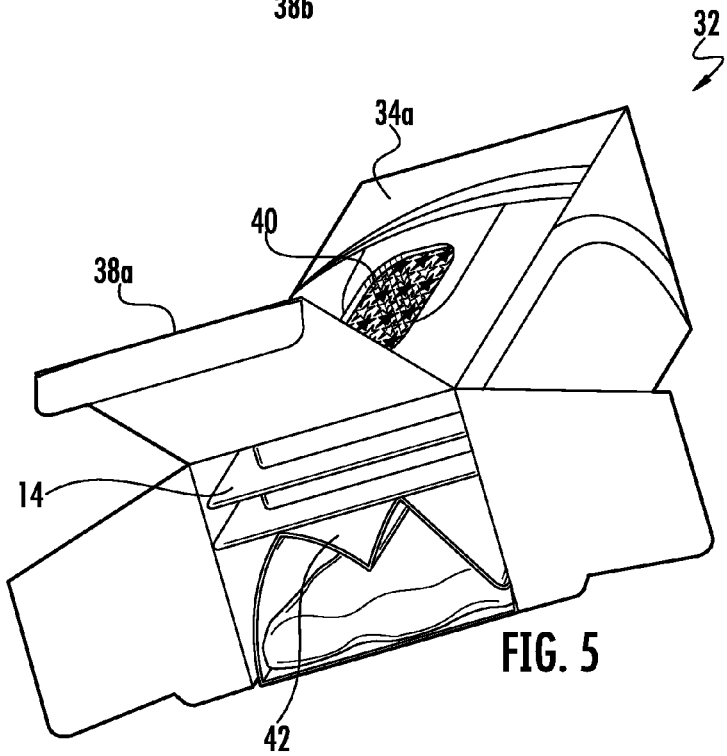
FIG. 5 is a top, perspective view of the container of FIG. 4 showing pods and other items therein according to an embodiment of the invention.

FIG. 5 shows a container 32 that is opened. Two pods 14 are shown positioned inside the cavity of container 32. As shown, at least one pod 14 is positioned such that its transparent well is aligned with the cutout 40—thus allowing the appliqué to be viewed through the packaging. In the example shown in FIGS. 4 and 5, the star designs on the appliqués are visible through cutout 40 and through the pod well 16.

In a preferred embodiment a supporting wall, tab or such similar retaining structure 42 is provided inside of container 32 to hold a pod (or pods) in position where a transparent portion thereof (e.g. the well 16) is at least partially aligned with cutout 40. The retaining structure preferably runs along a portion of the height of the container and is positioned to form a pocket or retaining wall to hold a pod or pods aligned with the cutout.

In accordance with the principles of this invention, enamel nail appliqués are stored one behind the other in a pod package preferably made of plastic easily opened and closed. When closed, the closure is sealed tight, preventing further drying of the enamel formed as part of the appliqué.

In use, a user opens the pod and sorts through the appliqués to pick a suitable appliqué size. She then may put the remaining appliqués stacked one on top of the other back in the pod. On the other hand, a customer may just choose to remove the top appliqué, leaving the remaining appliqués undisturbed and remove the appliqués one after the other applying them to the fingernails.

Appliqués which are double sided can be used for the fingernails on both hands, and some users are able to open the pod with one hand, remove the appliqués one by one and apply them to the fingernails of the other hand.

The pod serves as a convenient container for the user who is able to keep the container close at hand while applying the appliqués one after the other to fingernails of one hand then to the fingernails of the other hand. This convenience is markedly noticed by regular users of the invention.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

What is claimed is:

1. In combination a pod package, a plurality of individual, discrete enamel nail appliqués and an outer package, said pod package having a single well and a well cover removably attached to said well, all of said appliqués being positioned in said well and retained therein by said well cover, wherein said well cover forms an air-tight seal of said well, said outer package comprising a container having an inner cavity, said pod package positioned in said inner cavity of said container, all of said appliqués being stacked with one another in said well of said pod package in a single stack, whereby said outer package is substantially rectangular or cylindrical in shape and is sized so as to fit in a single display area of a standard nail polish bottle display; and, wherein said well of said pod package comprises a floor and sidewalls, each of said sidewalls terminating in a lip, said lips comprising a peripheral area around said well, and said well cover being attached to said peripheral area.

2. The combination according to claim 1, wherein each of said appliqués has the same size.

3. The combination according to claim 1, wherein said appliqués are of different sizes and said well is sized to accommodate the largest of said appliqués.

4. The combination according to claim 1, wherein said appliqués are double ended.

5. The combination according to claim 1, wherein said well and said well cover are integrally formed as one unit.

6. The combination of claim 1, wherein said pod package is removable from said outer package.

7. The combination of claim 1, wherein said well is made from a clear material for permitting viewing of said appliqués.

8. The combination of claim 7, wherein said container includes a front wall and a rear wall, said front wall of said container including a window, at least one portion of said well of said pod package being aligned with said window to display said appliqués, said container including a retaining structure located in said cavity between said rear wall and said pod package and bearing on said pod package to hold said pod package against said window.

9. A nail appliqué packaging comprising:

at least one package;

a plurality of individual, discrete enamel nail appliqués contained in said at least one package, all of said nail appliqués being stacked with one another and retained in said at least one package in a single stack, whereby said at least one package is sized so as to fit in a single display area of a standard nail polish bottle display;

wherein said at least one package includes an air-tight inner package having a single well, all of said nail appliqués being stacked and retained in said well in a single stack;

wherein said at least one package includes an outer package, said inner package being received in said outer package;

wherein said well includes a clear portion for permitting viewing of at least one of said appliqués, said outer package including a window aligned with said clear portion of said inner package so as to display said at least one of said appliqués; and, wherein said window includes a cutout, which is formed in a front wall of said outer package, and a cover, which is made from one of transparent and translucent materials and covers said cutout.

10. The packaging of claim 9, wherein said at least one package includes another inner package including a single well and a plurality of enamel nail appliqués, all of which are stacked with one another and retained in said well of said another inner package in a single stack, said another inner package being stacked with said inner package in said outer package.

11. The packaging of claim 9, wherein said inner package includes a well cover removably attached to said well so as to retain said appliqués in said well, said well cover forming an air-tight seal with said well.

12. A nail appliqué packaging comprising:

at least one package;

a plurality of individual, discrete enamel nail appliqués contained in said at least one package, all of said nail appliqués being stacked with one another and retained in said at least one package in a single stack, whereby said at least one package is sized so as to fit in a single display area of a standard nail polish bottle display;

wherein said at least one package includes an air-tight inner package having a single well, all of said nail appliqués being stacked and retained in said well in a single stack;

wherein said at least one package includes an outer package, said inner package being received in said outer package;

wherein said outer package includes a front wall and a rear wall, said front wall of said outer package include a window, said well of said inner package including a clear portion aligned with said window to display at least one of said appliqués, said outer package including a retaining structure located between said rear wall and said inner package and bearing on said inner package to hold said inner package against said window.

13. The packaging of claim 12, wherein said well of said inner package includes a floor and sidewalls, each of said sidewalls terminating in a lip, said lips including a peripheral area around said well, and said well cover being attached to said peripheral area; and, wherein said inner package includes a well cover removably attached to said well so as to retain said appliqués in said well, said well cover forming an air-tight seal with said well.

* * * * *